US012507767B2

(12) United States Patent
Maseguchi et al.

(10) Patent No.: US 12,507,767 B2
(45) Date of Patent: Dec. 30, 2025

(54) SLIDE FASTENER, PRODUCTION METHOD FOR SAME, AND SEWN SLIDE FASTENER ARTICLE

(71) Applicant: YKK Corporation, Tokyo (JP)

(72) Inventors: Ryo Maseguchi, Toyama (JP); Yoshie Nakamae, Toyama (JP); Atsushi Ogihara, Toyama (JP); Yoshio Taira, Toyama (JP); Hikaru Sato, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 18/560,631

(22) PCT Filed: May 17, 2021

(86) PCT No.: PCT/JP2021/018628

§ 371 (c)(1),
(2) Date: Nov. 13, 2023

(87) PCT Pub. No.: WO2022/244066

PCT Pub. Date: Nov. 24, 2022

(65) Prior Publication Data

US 2024/0251917 A1 Aug. 1, 2024

(51) Int. Cl.
*A44B 19/02* (2006.01)

(52) U.S. Cl.
CPC ..... *A44B 19/02* (2013.01)

(58) Field of Classification Search
CPC ..... A44B 19/02; A44B 19/32; A44B 19/34
See application file for complete search history.

(56) References Cited

U.S. PATENT DOCUMENTS 2,335,668 A * 11/1943 Hamm ..... A44B 19/06 24/411
2007/0226966 A1* 10/2007 Tominaga ..... A44B 19/32 24/389
2010/0154179 A1* 6/2010 Blackford ..... A44B 19/34 24/399
2014/0366337 A1* 12/2014 Chou ..... A44B 19/24 24/389

(Continued)

FOREIGN PATENT DOCUMENTS

CN 106061312 A 10/2016
CN 106572726 A 4/2017

(Continued)

OTHER PUBLICATIONS

International Search Report, PCT Patent Application No. PCT/JP2021/018628, Jul. 13, 2021, 5 pages.

(Continued)

*Primary Examiner* — David M Upchurch
(74) *Attorney, Agent, or Firm* — Kilpatrick Townsend & Stockton LLP

(57) ABSTRACT

A slide fastener includes a pair of left and right fastener tapes; and a pair of element rows including a plurality of fastener elements that face edge portions of the fastener tapes on sides facing each other along a length direction of the fastener tapes, and to which a slider that engages with the pair of element rows is slidably attached. The fastener element is made of a metal, a water-repellent layer made of a water-repellent agent is provided on the fastener tape, and adhesion of water to the fastener tape is prevented by the water-repellent layer.

7 Claims, 5 Drawing Sheets

(56) References Cited

U.S. PATENT DOCUMENTS

| | | | | |
|---|---|---|---|---|
| 2015/0107062 | A1 | 4/2015 | Hayashi et al. | |
| 2015/0157096 | A1* | 6/2015 | Mikuma | A44B 19/32 24/389 |
| 2017/0251772 | A1 | 9/2017 | Yamamoto et al. | |
| 2017/0332744 | A1* | 11/2017 | Kameyama | B29C 43/28 |
| 2018/0049521 | A1 | 2/2018 | Koizumi et al. | |
| 2018/0110302 | A1 | 4/2018 | Chou | |
| 2018/0317614 | A1* | 11/2018 | Hosokawa | A44B 19/403 |
| 2019/0380455 | A1* | 12/2019 | Sho | A44B 19/26 |
| 2021/0037930 | A1* | 2/2021 | Lin | A44B 19/346 |

FOREIGN PATENT DOCUMENTS

| | | | |
|---|---|---|---|
| CN | 211323299 | U | 8/2020 |
| DE | 202017106328 | U1 | 1/2018 |
| JP | 3192141 | U | 7/2014 |
| JP | 2014-236856 | A | 12/2014 |
| WO | 2013/145257 | A1 | 10/2013 |
| WO | 2016/143138 | A1 | 9/2016 |

OTHER PUBLICATIONS

Written Opinion, PCT Patent Application No. PCT/JP2021/018628, Jul. 13, 2021, 5 pages.

International Preliminary Report on Patentability, PCT Patent Application No. PCT/JP2021/018628, Nov. 21, 2023, 11 pages.

Office Action, Vietnamese Patent Application No. 1-2023-07618, Mar. 27, 2025, 4 pages.

Office Action, Chinese Patent Application No. 202180098110.4, Aug. 29, 2025, 14 pages.

* cited by examiner

SLIDE FASTENER, PRODUCTION METHOD FOR SAME, AND SEWN SLIDE FASTENER ARTICLE

TECHNICAL FIELD

The present invention relates to a slide fastener used for opening and closing an opening and closing portion of clothes, bags, and the like, and for attaching and removing a joint portion of a joined article, a method of manufacturing a slide fastener, and a slide fastener sewn article.

BACKGROUND ART

In a related art, a slide fastener generally is attached to an opening and closing portion of clothes, bags, and the like, and a joint portion of a joined article and the like, and a configuration thereof includes a pair of tapes attached in a state of facing the opening and closing portion and the like, fastener elements disposed at equal intervals on facing edge portions of the pair of tapes, a slider configured to engage or separate facing fastener elements while sliding rows of the facing fastener elements, and a lower stopper and an upper stopper provided at end edges of the rows of the fastener elements and configured to stop sliding of the slider.

The fastener element is made of resin and made of a metal. The metal has high joint strength and a luxurious appearance. The metal to be used is a copper alloy or an aluminum alloy, which is put into practical use. A stainless steel has higher hardness than copper and aluminum, so the stainless steel has excellent scratch resistance, but when the stainless steel is used for a slide fastener, there is a problem that the stainless steel is too hard and a life of a mold or the like until the stainless steel is processed into an element is shortened. Further, at the time of processing such as attaching an element to a fastener tape, it is desirable to use a metal having a certain degree of flexibility. Therefore, the stainless steel has a disadvantage as a material for the slide fastener.

For the above reasons, so far, there have been examples showing that the stainless steel is used after being subjected to a special carburizing treatment in a case of special applications such as that used in the sea as in Patent Literature 1, but not in a state of being widely used in a market as a general-purpose product. However, in recent years, market needs for the slide fastener made of the stainless steel are increasing, especially in a general-purpose field such as bags, because an increasing preference for an appearance of high quality and a texture such as gloss peculiar to the stainless steel are preferred. An inventor of the present application develops a slide fastener made of the stainless steel in order to meet such market needs, finds that there are following new problems that have not been expected so far, and solves the problems with a new idea that is not present in a related art.

CITATION LIST

Patent Literature

Patent Literature 1: Japanese Patent Publication No. 2013-120852

SUMMARY OF INVENTION

Technical Problem

In general, a stainless steel is recognized as having a property of being resistant to rust. However, the inventor of the present application finds that when the stainless steel is used as an element of the slide fastener and a test using salt water is performed, rust occurs from a portion where the element is in contact with a fastener tape (a portion on a tape side of a portion of the element that is crimped to the fastener tape), and the rust permeates and spreads in the fastener tape, causing a new problem that a stain is noticeable. When the same test using salt water is performed on a slide fastener equipped with an element made of the copper alloy in a related art, an element surface tends to be corroded as a whole. That is, a fact that rust intensively occurs at a portion where the element is in contact with the fastener tape is not seen in the copper alloy, and is a problem peculiar to the slide fastener made of the stainless steel.

Therefore, when a cause of such a problem is analyzed in detail with an enlarged photograph or the like, it is found that a fine hole of 20 μm to 30 μm is formed in the portion where the element is in contact with the fastener tape. This is considered to be a hole (pitting corrosion) in which, due to an influence of chloride ions in salt water, a passivation film (protective film) necessary for exhibiting a rust preventive action of the stainless steel is broken, an inside iron is in an exposed state, and corrosion of iron that easily rusts progresses by contact with salt water. The gloss is maintained at a portion other than a pitting corrosion site, but when rust occurs from the pitting corrosion site, a red stain of iron rust is noticeable on the tape. It is considered that the pitting corrosion is likely to occur due to a structure peculiar to the slide fastener in which inner peripheral surfaces of a pair of leg portions that sandwich and hold the fastener tape are continuously in contact with the salt water that permeates into the fastener tape for a long period of time. Therefore, it is necessary to take measures against the pitting corrosion peculiar to the fastener element made of the stainless steel. However, a method such as the carburizing treatment described in Patent Literature 1 has many treatment steps, is complicated, and requires a large-scale device, and therefore is not suitable as a method of popularizing in the market as a general-purpose product in terms of cost.

The present invention is made in view of the above background and problems, and an object of the present invention to provide a slide fastener, a method of manufacturing a slide fastener, and a slide fastener sewn article in which occurrence of rust on a fastener element made of a metal, in particular, a fastener element made of a stainless steel, is reliably prevented by a simple method and a good appearance is maintained.

Solution to Problem

The present invention provides a slide fastener, including a pair of left and right fastener tapes; and a pair of element rows including a plurality of fastener elements that face edge portions of the fastener tapes on sides facing each other along a length direction of the fastener tapes, and to which a slider that engages with the pair of element rows is slidably attached, in which the fastener element is made of a metal, a water-repellent layer made of a water-repellent agent is provided on the fastener tape, and adhesion of water to the fastener tape is prevented by the water-repellent layer. Further, it is preferable that the water-repellent agent is adhered to a portion of the fastener tape that is in contact with the fastener element.

It is preferable that a coating layer made of a coating agent is provided on the fastener element. It is preferable that the coating layer of the fastener element is also provided at a portion of the fastener element that is in contact with the fastener tape. The fastener element is preferably made of a stainless steel.

The present invention provides a method of manufacturing a slide fastener, including: forming individual fastener elements made of a metal: forming fastener stringers by attaching the fastener elements to one edge portion along a longitudinal direction of a long fastener tape: forming a water-repellent layer by adhering a water-repellent agent to the fastener element and the fastener tape; and attaching a slider to a pair of the fastener stringers.

A coating layer is formed on an element substrate made of a stainless steel, to form the fastener element. At least one of the coating layer made of the coating agent and the water-repellent layer made of the water-repellent agent is formed by spraying or immersion.

The present invention provides a slide fastener sewn article in which the slide fastener is sewn, in which a main body portion to which the slide fastener of the sewn article is attached is a cloth, leather or synthetic leather that is not subjected to a water-repellent treatment with a water-repellent agent.

Advantageous Effects of Invention

According to the slide fastener and the method of manufacturing a slide fastener of the present invention, it is possible to reliably prevent the occurrence of rust on the fastener element made of the metal, in particular, the fastener element made of the stainless steel, by a simple method, and to maintain a good appearance. So far, in order to prevent water from entering an inside through the slide fastener, applying a water-repellent agent to the fastener tape has been performed in a related art, and in this case, in particular, it has been performed in a slide fastener made of an element made of resin. However, the present invention has a fundamentally different idea from use of the water-repellent agent in the related art for the purpose of preventing entry of water in that the water-repellent agent is used for the purpose of preventing rust from being occurred from a portion where the element made of the metal is in contact with the fastener tape. The idea is fundamentally different from the slide fastener in the related art to which the water-repellent agent is applied in order to prevent the entry of water in that the slide fastener in the related art to which the water-repellent agent is applied in order to prevent the entry of water is implicitly assumed to be attached to a product such as a garment, which is assumed to be used in an environment wetted with rainwater or the like, but the present invention is not necessarily assumed to be used in an environment wetted with rainwater or the like. Thus, in the present invention, by providing the fastener tape with the water-repellent layer made of the water-repellent agent, it is possible to prevent water adhering to an inner crotch portion of the element made of the metal through the fastener tape and obtain a high rust preventive effect of the fastener element.

Accordingly, also in the sewn article to which the slide fastener of the present invention is attached, rust is less likely to occur in the fastener element made of the metal, stains on the fastener tape due to rust can be prevented, and a beautiful appearance can be maintained for a long period of time. That is, even in a case where salt water of seawater is accidentally applied to a slide fastener portion of the sewn article on a beach or the like, the rust occurred from the inner crotch portion of the metal element can be prevented, and the good appearance of the sewn article of a bag or the like to which the slide fastener is attached can be maintained. For this purpose, it is assumed that a fabric to which the slide fastener of the present invention is attached does not require treatment with the water-repellent agent.

DESCRIPTION OF EMBODIMENTS

Figure 1:
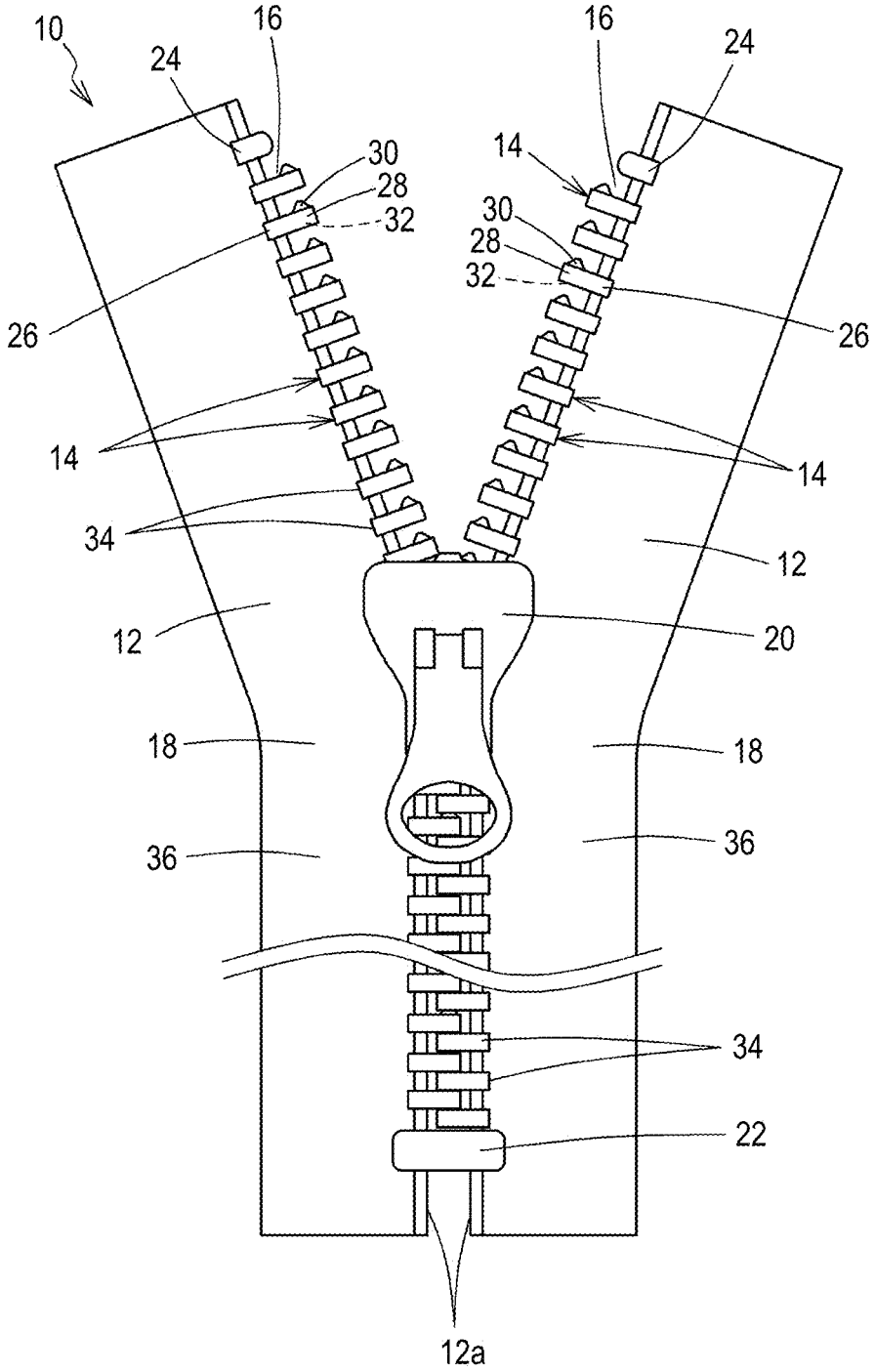
FIG. 1 is a front view of a slide fastener according to an embodiment of the present invention.
Figure 2A:
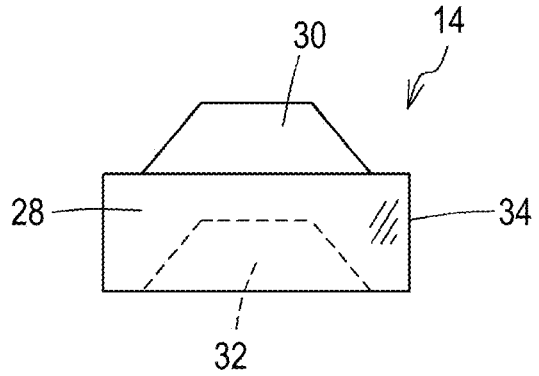
FIG. 2A is a plan view of one fastener element of the slide fastener according to the embodiment.
Figure 2B:
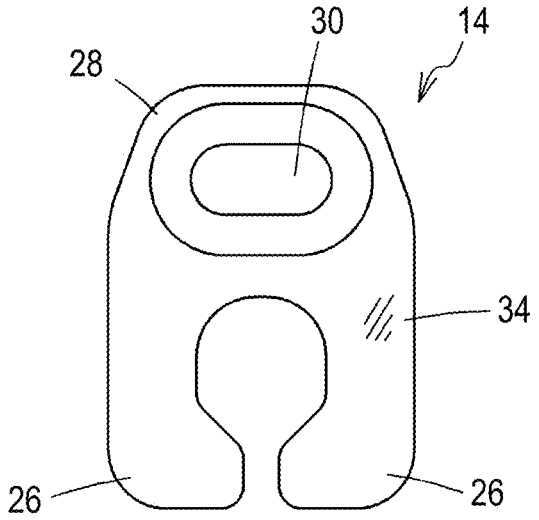
FIG. 2B is a front view of one fastener element of the slide fastener according to the embodiment.
Figure 2C:
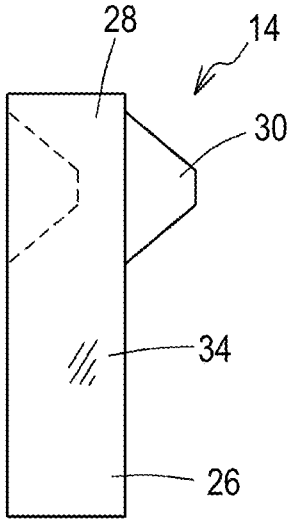
FIG. 2C is a right side view of one fastener element of the slide fastener according to the embodiment.
Figure 2D:
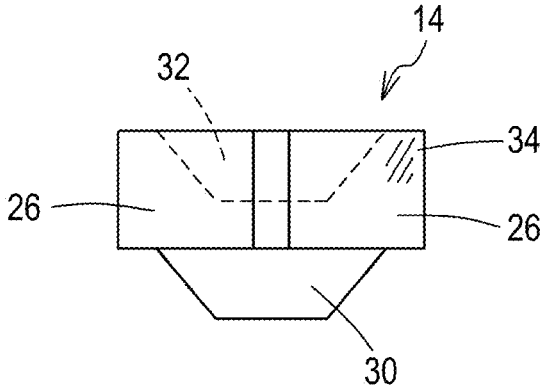
FIG. 2D is a bottom view of one fastener element of the slide fastener according to the embodiment.
Figure 3A:
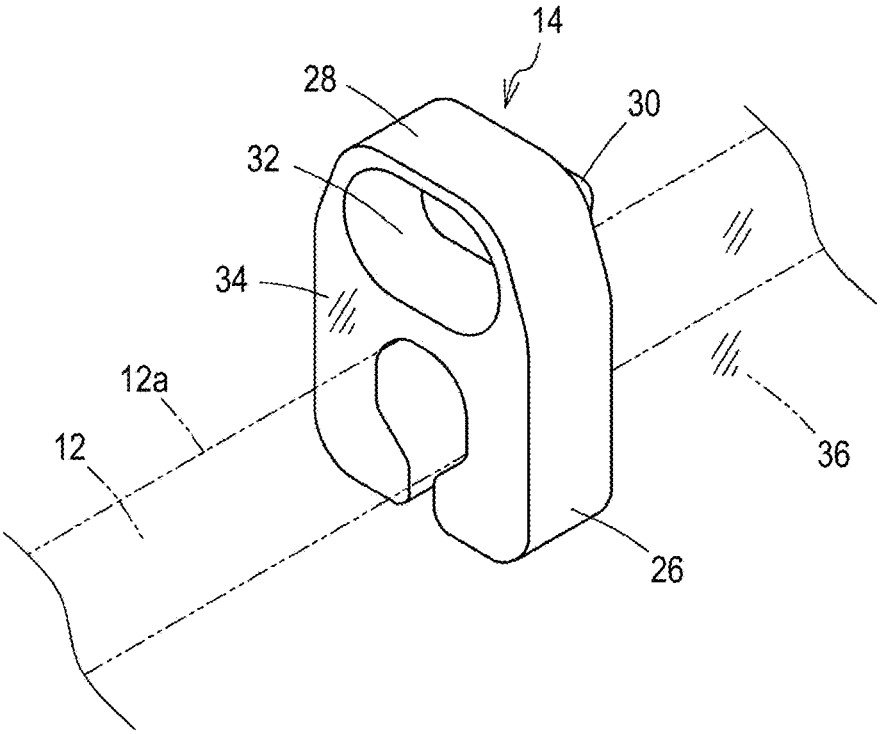
FIG. 3A is a perspective view (a) seen from a concave portion side of one fastener element of the slide fastener according to the embodiment.
Figure 3B:
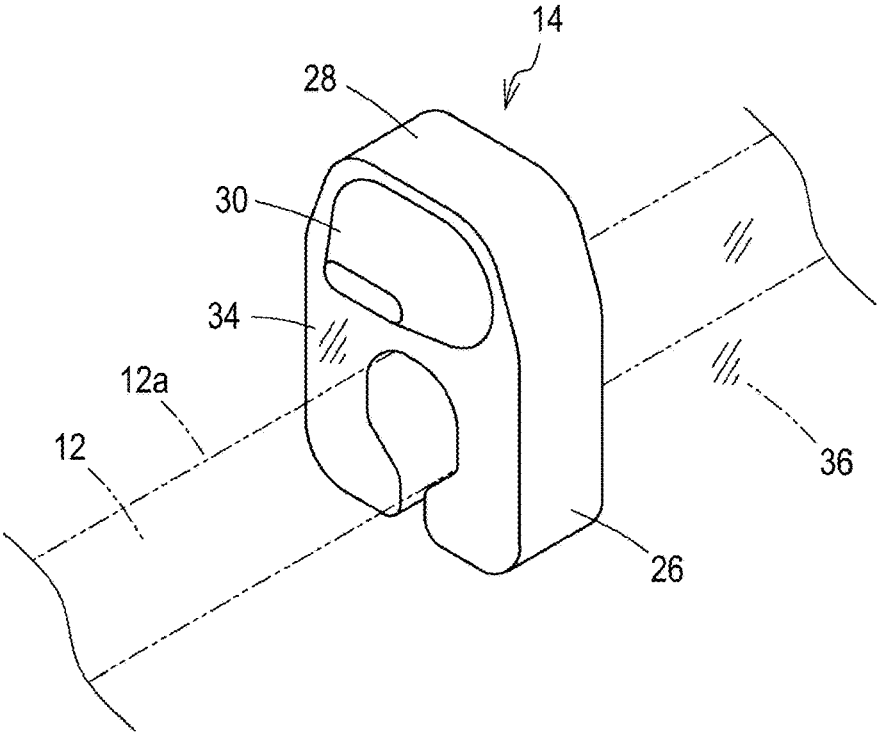
FIG. 3B is a perspective view seen from a convex portion of one fastener element of the slide fastener according to the embodiment.

Hereinafter, an embodiment of the present invention will be described with reference to the drawings. FIG. 1 shows a slide fastener 10 according to an embodiment of the present invention. The slide fastener 10 according to the embodiment includes a pair of left and right fastener tapes 12; and a pair of element rows 16 including a plurality of fastener elements 14 that face edge portions 12*a* of the fastener tapes 12 on sides facing each other along a longitudinal direction of the fastener tapes 12. The edge portion 12*a* of the fastener tape 12 is provided with a core strand portion that bulges in a front and back direction, and the element row 16 is fixed to the core strand portion of the edge portion 12*a*.

A slider 20 in which the fastener elements 14 engage with each other is slidably attached to the pair of element rows 16 by passing through the element rows 16. A lower stopper 22 that limits a range of movement of the slider 20 is provided at lower end portions of the pair of element rows 16, and an upper stopper 24 that limits the range of movement of the slider 20 is provided at upper end portions of the pair of element rows 16.

The fastener element 14 of the embodiment is formed of a stainless steel in which iron contains a certain amount or more of chromium. Types of the stainless steel include, for example, a ferrite-based stainless steel containing 16.0% to 18.0% of chromium, or an austenitic stainless steel containing 8.0% to 10.50% of nickel and 18.0% to 20.0% of chromium, and a stainless steel of other components may be used.

Next, a shape of the fastener element 14 will be described with reference to FIGS. 2A to 3B. A pair of leg portions 26 that sandwich and hold the edge portion 12*a* of the fastener tape 12 from a thickness direction of the fastener tape 12, and a connecting portion 28 to which the pair of leg portions 26 are connected are included. The connecting portion 28 has a pair of side surfaces parallel to a direction in which the pair of leg portions 26 face each other and intersecting a longitudinal direction of the fastener tape 12, a convex portion 30 protruding from a side surface is provided on one of the side surfaces, and a concave portion 32 having a size for fitting the convex portion 30 is provided on a side surface opposite to the convex portion 30.

As shown in FIG. 1, in an engagement of left and right fastener elements 14, by a movement of the slider 20 upward in the drawing which is a closing direction, the convex portion 30 of the fastener element 14 of a pair of fastener stringers 18 on a left side of the drawing is fitted into the concave portion 32 of the fastener element 14 on a right side, and the convex portion 30 of the fastener element 14 on the right side is fitted into the concave portion 32 of the fastener element 14 on the left side, and this is continuously performed. In addition, by a movement of the slider 20 downward in the drawing, the engagement of the left and right fastener elements 14 is released, and coupling of the pair of fastener stringers 18 is released.

A surface of the fastener element 14 is subjected to a coating treatment, and a coating layer 34 is provided. A material of a coating agent used in the coating treatment is, for example, a polyvinyl alcohol-based polymer or a silicone-based polymer. Further, in the slide fastener 10, the fastener element 14 is attached to the fastener tape 12, and thereafter, subjected to a water washing treatment, and then subjected to a water-repellent treatment, and a water-repellent layer 36 is provided on a fiber surface of the fastener tape 12. A material of a water-repellent agent used in the water-repellent treatment is, for example, a polyvinyl alcohol-based polymer or a silicone-based polymer.

The coating layer 34 and the water-repellent layer 36 provide the fastener element 14 with a rust preventive effect. In particular, since water does not permeate into the fastener tape 12 by the water-repellent layer 36, inner peripheral surfaces of the pair of leg portions 26 of the fastener element 14 that sandwich and hold the fastener tape 12 are prevented from coming into contact with the water that permeates into the fastener tape 12, and occurrence of rust on the inner peripheral surfaces of the pair of leg portions 26 that are easily corroded is prevented. That is, by providing the water-repellent layer 36 with the water-repellent agent on the fastener stringer 18, the rust preventive effect of the slide fastener 10 can be obtained.

Figure 4:
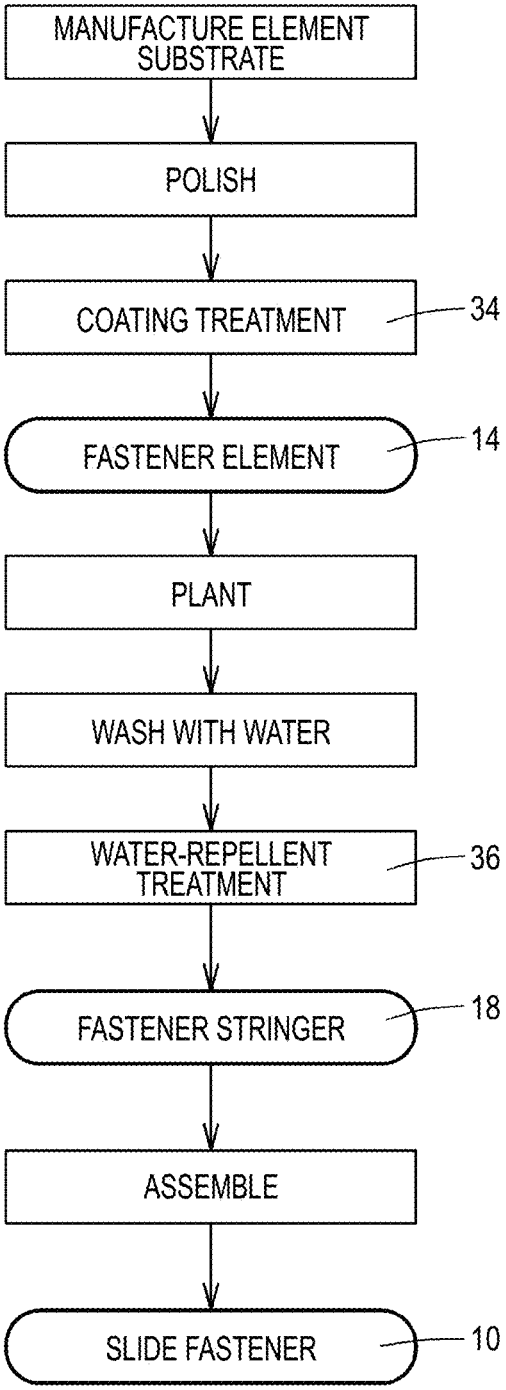
FIG. 4 is a schematic view of a method of manufacturing a slide fastener according to the embodiment.

Next, a method of manufacturing the slide fastener 10 will be described with reference to FIG. 4. First, an element substrate made of the stainless steel is manufactured. The manufacturing method is a known method in a related art, and for example, by punching a rectangular wire rod made of a stainless steel into a predetermined element shape using a cutting punch and a cutting die, the element substrate is manufactured. Alternatively, by processing the element into a long wire rod having an element shape in a cross section called a Y bar, and cutting the Y bar to a desired thickness, the element substrate is manufactured. A method of manufacturing the element substrate of the embodiment is not limited to this, and an appropriate method of manufacturing the element substrate can be selected.

Next, the element substrate is polished. A polishing method is similar to that of a related art, and for example, a polishing step such as barrel polishing or chemical polishing is performed by putting into a liquid processing container. A burr of the element substrate is removed by polishing, and a surface becomes smooth.

Next, the element substrate subjected to the polishing step is subjected to a coating treatment. A coating treatment method is also similar to that of a related art, and for example, by putting the element substrate into a bucket, and spraying the coating agent while rotating the bucket, the element substrate is coated, the coating layer 34 is formed on the surface, and the fastener element 14 has a rust preventive effect. In particular, it is important that the coating layer 34 is applied up to the inner peripheral surfaces of the pair of leg portions 26 that sandwich and hold the fastener tape 12 by spraying the coating agent while rotating the bucket in this way.

Thereafter, the fastener element 14 is planted on the fastener tape 12. A planting method is similar to that of a related art, and for example, after the fastener element 14 is put into a parts feeder and a posture of the fastener element 14 is adjusted, the fastener element 14 is supplied to the edge portion 12*a* of the fastener tape 12 via a shooter so that the core strand portion of the edge portion 12*a* is sandwiched between the pair of leg portions 26 of the fastener element 14. Thereafter, the fastener element 14 supplied to the edge portion 12*a* of the fastener tape 12 is planted in the edge portion 12*a* of the fastener tape 12 by being crimped by a crimping method.

Next, the fastener tape 12 to which the fastener element 14 is attached is washed with water as described above. In a water washing method, for example, the fastener tape 12 to which the fastener element 14 is attached is put in a water tank filled with a water washing liquid, immersed in the water washing liquid, and stirred. The water washing liquid may contain a rust inhibitor. Then, the adhered water washing liquid may be removed by a suction device.

After washing with water, a water-repellent treatment is performed. In a water-repellent treatment method, for example, the fastener tape 12 to which the fastener element 14 is attached and which is washed with water is put into a water tank filled with a water-repellent agent, immersed in the water-repellent agent, and stirred. Then, the adhered water-repellent agent may be removed by the suction device. Accordingly, the water-repellent layer 36 made of the water-repellent agent is formed on the fiber surface of the fastener tape 12 and the surface of the fastener element 14, and the fastener stringer 18 having a water-repellent function can be formed.

As a more preferred embodiment, the fastener tape 12 may be immersed in the water-repellent agent until the water-repellent agent sufficiently permeates into a portion of the fastener tape 12 that is in contact with the fastener element 14. In other words, the portion of the fastener tape 12 that is in contact with the fastener element 14 is a portion of the fastener tape 12 that is sandwiched between the pair of leg portions 26 of the fastener element 14. Accordingly, it is possible to more effectively prevent a situation in which the element directly touches salt water or the like.

The fastener stringer 18 has a water-repellent function by the water-repellent layer 36, and in particular, the water-repellent agent adhered to the fastener tape 12 is less likely to drop than the water-repellent agent adhered to the surface of the fastener element 14, so that water does not permeate into the fastener tape 12 even after long-term use, the inner peripheral surfaces of the pair of leg portions 26 of the fastener element 14 that sandwich and hold the fastener tape 12 do not come into contact with the water that permeates into the fastener tape 12. Therefore, the occurrence of rust on the inner peripheral surfaces of the pair of leg portions 26, which are likely to be corroded, is prevented. In particular, in the fastener stringer 18, the coating layer 34 has a rust preventive effect on the fastener element 14, and further, the water-repellent layer 36 prevents water from permeating into the fastener tape 12, so that the fastener element 14 has a high rust preventive effect. The water-repellent layer 36 may be provided only on the fastener tape 12.

Then, the slider 20, the lower stopper 22, and the upper stopper 24 are attached to the fastener stringer 18, and manufacture of the slide fastener 10 is completed. An assembly method is similar as that of a general slide fastener in a related art.

Although the water-repellent agent is applied to the slide fastener in the related art, they are attached to a product such as a garment that is assumed to be used in an environment wetted with rainwater or the like. That is, a main body portion of a sewn article to which the slide fastener is attached is a cloth subjected to the water-repellent treatment with the water-repellent agent.

In contrast, the slide fastener 10 according to the embodiment of the present invention differs greatly from the water repellent slide fastener in the related art in that the slide fastener 10 is used even when the slide fastener 10 is sewn to a fabric not subjected to the water-repellent treatment with the water-repellent agent. That is, the main body portion of the sewn article to which the slide fastener 10 of the embodiment of the present invention is attached differs greatly from the water repellent slide fastener in the related art in that the main body portion is a cloth (including not only woven fabrics but also knitting, felt, non-woven fabric, and the like), leather, synthetic leather, or the like that are not subjected to the water-repellent treatment with the water-repellent agent. Even bags and clothes that are not assumed to be used in an environment wetted with rainwater or the like, in other words, ordinary bags and clothes to which no special waterproof process is applied, can accidentally be wetted with seawater. In such a case, it is an object and effect of the present invention to prevent the occurrence of rust from a metal element.

According to the slide fastener 10 of the embodiment, it is possible to reliably prevent the occurrence of rust in fastener element 14 made of the stainless steel by a simple method, and to maintain a good appearance. The coating layer 34 made of a coating agent is provided on the surface of the fastener element 14 before the fastener element 14 is attached to the fastener tape 12, and the rust preventive effect is high. Further, by providing the water-repellent layer 36 made of the water-repellent agent on the fastener stringer 18, water does not permeate into the fastener tape 12, and a higher rust preventive effect of the fastener element 14 can be obtained. In particular, since water does not permeate into the fastener tape 12 by the water-repellent layer 36, the inner peripheral surfaces of the pair of leg portions 26 of the fastener element 14 that sandwich and hold the fastener tape 12 do not come into contact with the water that permeates into the fastener tape 12. Therefore, the occurrence of rust on the inner peripheral surfaces of the leg portions 26, which are likely to be corroded, can be prevented. Accordingly, the slide fastener 10 made of the stainless steel can be used also for a product that is in contact with seawater or is used in an environment exposed to sea wind. For example, even at beach resorts and cruises, clothes and bags using the fastener element 14 made of the stainless steel having a good texture can be used outdoors.

In a slide fastener sewn article provided with the slide fastener 10 according to the embodiment, rust is less likely to occur in the fastener element 14 made of the stainless steel, and occurrence of stains on the fastener tape 12 due to rust can be prevented, and a beautiful appearance can be maintained for a long period of time. Further, even in use in a beach or the like, it is possible to prevent the occurrence of rust, and to maintain good appearance of clothes, bags, and other products.

A method of producing the fastener element, each treatment method, the planting method to the fastener tape, and the like of the present invention can be appropriately changed, and a material of the fastener element may be other than the above, and may be other stainless steel or other than stainless steel. The materials of the coating agent and the water-repellent agent may be other than those described above.

The present invention is, in particular, an invention based on a new problem found by detailed analysis of a result of a salt water test on the element made of the stainless steel, and thus it is needless to say that the present invention is applied to the slide fastener made of the element made of the stainless steel, but it is obvious that the present invention exhibits the same effect even if the present invention is applied to an element made of a metal other than stainless steel. That is, in a case of the stainless steel, the effect can be visually confirmed in a short period of time, but it is clear that the metal other than the stainless steel has a certain effect even if an effect cannot be visually confirmed to that extent. Therefore, the present invention can also be said to be a technical idea applicable to a slide fastener made of a metal element other than the stainless steel.

EXAMPLE

With respect to the slide fastener 10 of the present invention, corrosion resistance against salt water was evaluated. In an evaluation method, a salt water spray tester is used to spray a neutral sodium chloride aqueous solution on the fastener stringer 18 for a specified time in a constant atmosphere, and then a change in an appearance is observed. The salt water spray tester used was STP-90V-4 manufactured by Suga Test Instruments Co., Ltd. An electronic balance having a minimum memory of 1 g or less and a maximum weight of 1000 g or more is used, and another pH meter is used.

Test conditions are a test tank temperature of 35±2° C., an air saturator temperature of 47±2° C., and supply air of 0.098±0.010 MPa (1±0.1 kg/cm$^2$). A sodium chloride solution has a concentration of 5% (50±5 g/l), a specific gravity of 1.029 to 1.036 (at 25° C.), and a pH of 5.0 to 8.0 (at the time of adjustment). Water used for the sodium chloride solution is deionized water or distilled water (preferably 1 μS/cm or less) having a temperature of 25±2° C. and an electric conductivity of 20 μS/cm or less. Salt used is of a special grade or higher specified in JIS-K-8150. An amount of spray liquid collected is 1.5±0.5 ml/hr/80 cm$^2$. A test time is 96 hours.

Next, a test procedure will be described. First, test samples are prepared. The test samples are the fastener stringer 18 used for the slide fastener 10 of the present application and a fastener stringer in a related art for comparison. In the fastener stringer 18, the fastener element 14 is subjected to a coating treatment, and further subjected to a water-repellent treatment in a state where the fastener element 14 is attached to the fastener tape 12. In the fastener stringer in the related art, these two types of treatments are not performed.

Then, a 5% sodium chloride aqueous solution is prepared, and it is confirmed whether the pH is 5.0 to 8.0. The sodium chloride solution is well mixed so as not to get stuck in a nozzle or the like. Next, a tester is prepared in accordance with an operation procedure manual of the salt water spray tester, and test conditions are confirmed. Then, the test sample is set in the test tank of the tester. The fastener stringer of a sample is set in a suspended state. A set position and an interval should not interfere with a free fall of the spray so that drops from the sample do not drip onto other samples.

Next, an operation of the salt water spray tester is started. After an operation for a specified time, the sample is carefully removed and washed with tap water. A soft brush or the like is used to clean and remove adhered matters (salt and the like) other than a corrosion product on a surface so that the adhered matters cannot be seen visually. The cleaned sample is placed on a flat portion and air dried. Then, an appearance of the corrosion product is visually confirmed, and the corrosion resistance is evaluated.

Figure 5:
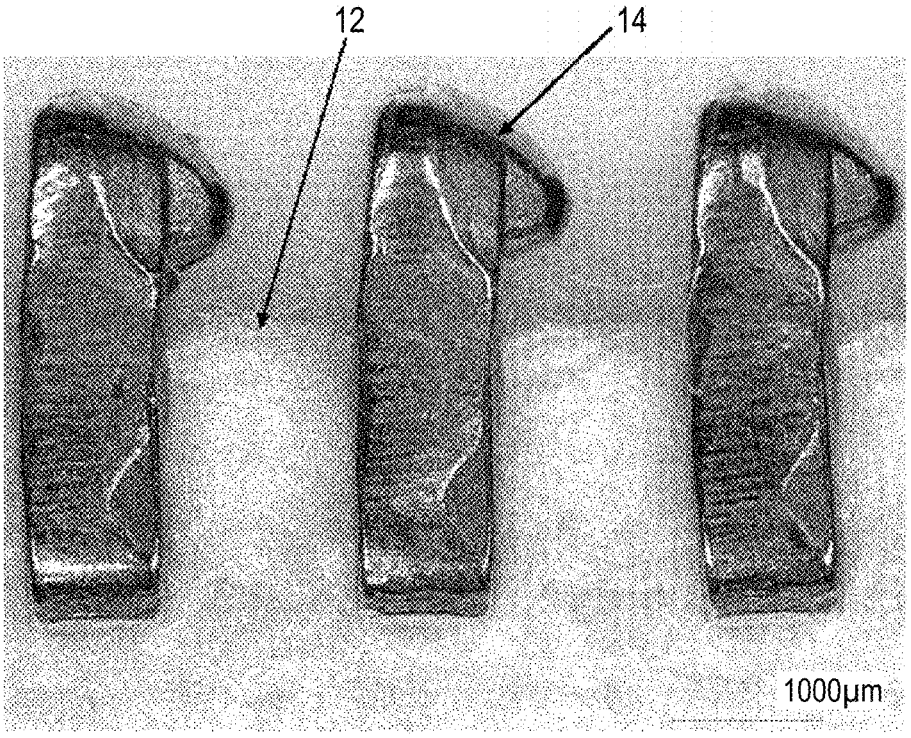
FIG. 5 is an image of a result of a salt water spray test in which corrosion resistance of the slide fastener of the embodiment is examined.
Figure 6:
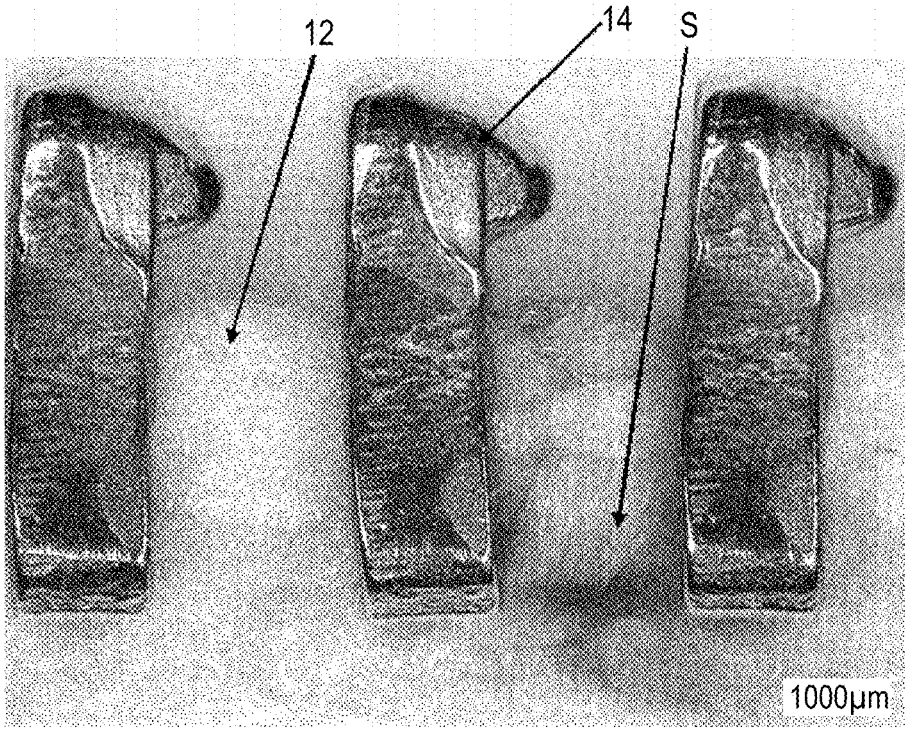
FIG. 6 is an image of a result of the salt water spray test in which corrosion resistance of the slide fastener in a related art is examined.

An enlarged image of the appearance of the corrosion product of the fastener stringer 18 according to the present invention is shown in FIG. 5. According to this image, no stains occur due to corrosion, and the fastener tape 12 is in a beautiful state. On the other hand, an enlarged image of an appearance of a corrosion product of the fastener stringer for comparison is shown in FIG. 6. According to this image, a red stain S due to iron rust was observed in a portion of the fastener tape 12 between a pair of fastener elements 14. It is considered that since the water-repellent treatment is not performed, salt water permeates into the fastener tape 12, the inner peripheral surfaces of the pair of leg portions 26 of the fastener element 14 that sandwich and hold the fastener tape 12 come into contact with the salt water that permeates into the fastener tape 12, corrosion occurs from this portion, and rust spread on the fastener tape 12 together with the salt water to cause a stains S. As a result, it can be seen that the slide fastener 10 according to the present invention has a high rust preventive effect due to the water-repellent treatment.

REFERENCE SIGNS LIST

10 slide fastener
12 fastener tape
12*a* edge portion
14 fastener element
16 element row
18 fastener stringer
20 slider
34 coating layer
36 water-repellent layer

The invention claimed is:

1. A slide fastener, including a pair of left and right fastener tapes; and a pair of element rows including a plurality of fastener elements that face edge portions of the fastener tapes on sides facing each other along a length direction of the fastener tapes, and to which a slider that engages with the pair of element rows is slidably attached, wherein the fastener elements are made of a metal, a water-repellent layer made of a water-repellent agent is provided on the fastener tapes, and adhesion of water to the fastener tapes is prevented by the water-repellent layer, a coating layer made of a coating agent is provided on the fastener elements, and the fastener elements have a rust preventive effect, the coating layer is made of a first polymer, and the water-repellent layer is made of a second polymer.

2. The slide fastener according to claim 1, wherein the water-repellent agent is adhered to a portion of the fastener tapes that are in contact with the fastener elements.

3. The slide fastener according to claim 1, wherein the coating layer of the fastener elements is also provided at a portion of the fastener elements that is in contact with the fastener tapes.

4. The slide fastener according to claim 1, wherein the fastener elements are made of a stainless steel.

5. A method of manufacturing a slide fastener comprising:

forming individual fastener elements made of a metal;

forming a fastener stringer by attaching the fastener elements to one edge portion along a longitudinal direction of a long fastener tape;

forming a water-repellent layer by adhering a water-repellent agent to the fastener elements and the fastener tape; and attaching a slider to a pair of the fastener stringers, wherein a coating layer is formed on an element substrate made of a stainless steel to form the fastener elements having a rust preventive effect, the coating layer is made of a first polymer, and the water-repellent layer is made of a second polymer.

6. The method of manufacturing a slide fastener according to claim 5, wherein at least one of the coating layer made of a coating agent and the water-repellent layer made of the water-repellent agent is formed by spraying or immersion.

7. A slide fastener sewn article in which the slide fastener according to claim 1 is sewn, wherein a main body portion to which the slide fastener of the sewn article is attached is a cloth, leather or synthetic leather that is not subjected to a water-repellent treatment with a water-repellent agent.

* * * * *